US006728479B2

(12) United States Patent
Tanaka

(10) Patent No.: US 6,728,479 B2
(45) Date of Patent: Apr. 27, 2004

(54) PANEL-TYPE HEATING ELEMENT AND METHOD FOR THE MANUFACTURE THEREOF

(75) Inventor: Mizuho Tanaka, Kowloon (HK)

(73) Assignee: Aoyagi (H.K.) Ltd., Kowloon (HK)

( * ) Notice: Subject to any disclaimer, the term of this patent is extended or adjusted under 35 U.S.C. 154(b) by 0 days.

(21) Appl. No.: 10/165,345

(22) Filed: Jun. 7, 2002

(65) Prior Publication Data

US 2002/0186968 A1 Dec. 12, 2002

(30) Foreign Application Priority Data

Jun. 11, 2001 (JP) ..... 2001-175802

(51) Int. Cl.[7] ..... H05B 3/20

(52) U.S. Cl. ..... 392/439; 392/438; 338/307; 338/308; 338/314; 219/543; 219/203; 219/528; 219/549

(58) Field of Search ..... 392/439, 438, 392/435, 432, 425; 338/307, 308, 309, 310, 311, 312, 313, 314; 219/543, 203, 213, 217, 219, 528, 529, 548, 549, 547

(56) References Cited

U.S. PATENT DOCUMENTS 4,057,671 A * 11/1977 Shoop ..... 219/203
5,028,759 A * 7/1991 Finley ..... 219/203
5,270,517 A * 12/1993 Finley ..... 219/203
5,493,102 A * 2/1996 Takase et al. ..... 219/547
5,824,994 A * 10/1998 Noda et al. ..... 219/203
5,902,505 A * 5/1999 Finley ..... 219/547
6,144,017 A * 11/2000 Millett et al. ..... 219/543
6,204,480 B1 * 3/2001 Woodard et al. ..... 219/203
6,472,636 B1 * 10/2002 Baldwin ..... 219/203
6,492,619 B1 * 12/2002 Sol ..... 219/203
6,515,631 B1 * 2/2003 Nakamura et al. ..... 219/203

* cited by examiner

*Primary Examiner*—Henry Bennett
*Assistant Examiner*—Fadi H. Dahbour
(74) *Attorney, Agent, or Firm*—Cooper & Dunham LLP; Donald S. Dowden

(57) ABSTRACT

The object of this invention is to provide a panel-type heating element having an excellent durability and high effectiveness in power saving. To attain this object, the present invention provides a panel-type heating element consisting of a base which a thin film containing zinc oxide and tin oxide can form a layer upon. The panel-type heating element is advantageously manufactured by a method comprising spraying a solution containing a zinc compound and a tin compound on a base. The solution then oxidizes by heating the base in a high temperature reaction chamber to form a thin film consisting of sediment containing zinc oxide and tin oxide on the surface of the base. As a result, the thin film gives the base excellent acid, water and chemical resistance, and heats quickly.

7 Claims, 2 Drawing Sheets

PANEL-TYPE HEATING ELEMENT AND METHOD FOR THE MANUFACTURE THEREOF

FIELD OF THE INVENTION

The present invention relates to a panel-type heating element having an excellent stability and method for the manufacture thereof.

THE BACKGROUND OF THE INVENTION

Hitherto, a facial heating element consisting of a base and a thin film of zinc oxide or tin oxide formed on said base has been provided. Said facial heating element has a poor stability and the electric resistance of said thin film may gradually increase by turning on electricity repeatedly to generate heat.

SUMMARY OF THE INVENTION

Accordingly, an object of the invention is to provide a facial heating element having an excellent stability. Said object can be attained by a panel-type heating element consisting of a base and a thin film containing zinc oxide and tin oxide formed on said base. Said base is generally mica, ceramics, glass, porcelain, earthenware, or plastics, and said panel-type heating element is preferably manufactured by a method comprising of spraying a solution containing a zinc compound and a tin compound which give oxides respectively by heating in a high temperature reaction chamber to form a thin film consisting of sediment containing zinc oxide and tin oxide on the surface of said base. The temperature of said chamber is preferably adjusted between 200° C. and 700° C.

DETAILED DESCRIPTION

Figure 1:
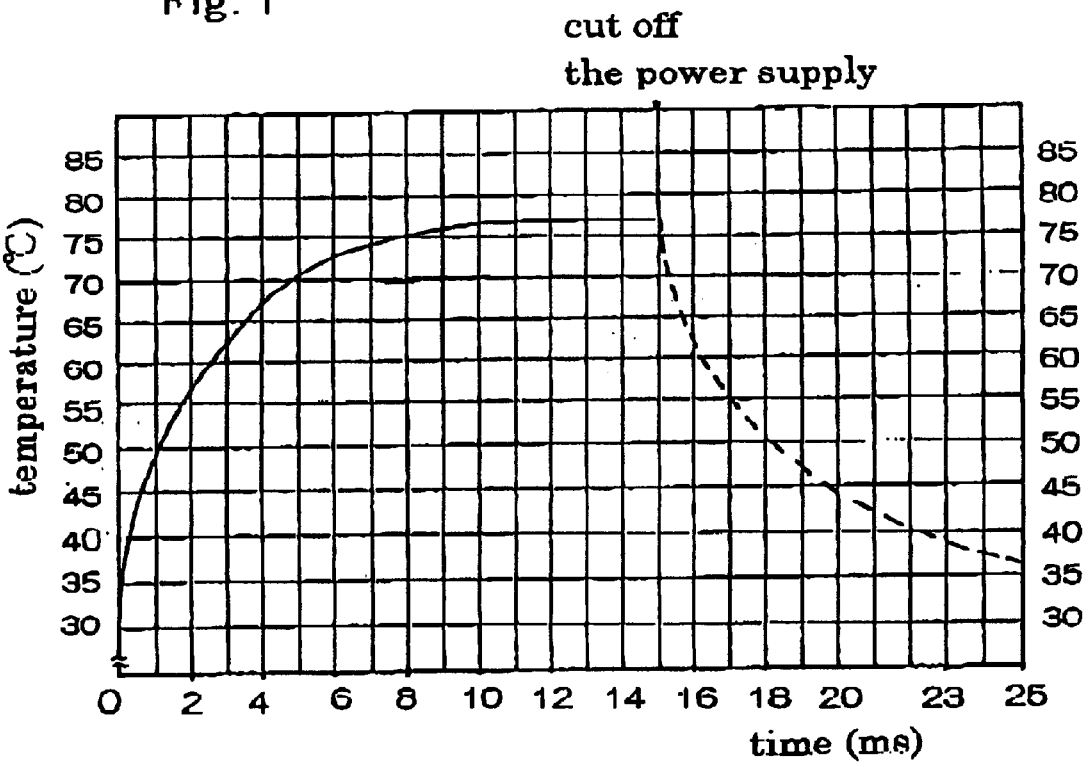
FIG. 1 is the ascending time-temperature test graph from EXAMPLE 1.

A panel-type heating element of the present invention consists of a base and a thin film containing zinc oxide and tin oxide. Tin oxide contained in said thin film may be SnO, and/or $Sn_3O_4$ and/or $SnO_2$, and zinc oxide contained in said film may be $ZnO_2$ and/or ZnO. The range of the weight ratio of zinc oxide to tin oxide contained in the said panel-type heating element may be as wide as 1:99 to 99:1. Said panel-type heating element having an excellent stability can be obtained in such a wide range of weight ratio.

Besides zinc oxide and tin oxide, if desirable, a small amount of other metal oxides such as antimony oxide, bismuth oxide, lead oxide, gallium oxide, indium oxide, ITO and/or the like may be contained in said film. Metal oxides having various valences can be used together in said film.

Further, a metal simple substance(s) such as zinc, tin, antimony, bismuth, lead, gallium, indium and/or the like may be contained in said film.

Generally speaking, metal oxide having a high valence may give a high electric resistance, and metal oxide having a low valence and metal simple substance give a low electric resistance.

Materials used commonly for said base may be mica, ceramics, glass, devitrified ceramics, porcelain, earthenware, or plastics. Usable ceramics for said base may be such as alumina, zirconia titania, silicon carbide, silicon nitride and/or the like. Usable plastics for said base may be thermosetting resin such as melamine resin, urea resin, phenol resin, epoxy resin, urethane resin and the like. Thermoplastic resin having heat resistance such as engineering plastics (e.g. silicone resin, vinyl fluoride resin, polyester having a high melting point, polyamide having a high melting point, polyacetal, polycarbonate, polysulfone, poly (ethersulfone), poly (phenylene oxide), poly (phenylene sufide), polyarylate, poly (etheretherketone), polyamideimide, polyimide, poly (etherimide), poly (aminobismaleimide), methyl pentene copolymer, bismaleimide-triazine type thermosetting aromatic polyimide) and the like may be used in this invention.

Further, in the case of a low temperature use common thermoplastic resin such as polyethylene, polypropylene, poly (vinyl chloride), polystyrene, polyester having a low melting point, polyamide having a low melting point and the like can be used in this invention.

To manufacture said panel-type heating element of the present invention, a method comprising coating a metal compound solution in which metal compounds of tin and zinc and, if desirable, other metal(s) are dissolved in water and/or organic solvent on said base and heating said base on which said metal compound solution is coated, and forming thin film of metal oxides produced from said metal compounds, or a method comprising spraying said metal compound solution on said base in a high temperature reaction chamber and forming a thin film of metal oxides produced from said metal compounds, is preferably applied. In said methods, usable metal compound, which become metal oxide by heating, is such as chloride, sulfide, hydroxide, hydroxide oxide, carbonate hydroxide, carbonate, bicarbonate, oxalate, alkoxide and the like.

And usable organic solvent is such as alcohol (e.g. methanol, ethanol, isopropanol, n-butanol, ethylene glycol, propylene glycol, glycerin), ether (e.g. ethyl ether, methyl ether), acetate (e.g. methyl acetate, ethyl acetate, n-butyl acetate), aromatic organic solvent (e.g. benzene, toluene, xylene), ketone (e.g. acetone, methyl ethyl ketone, methyl isobutyl ketone) pyridine, aniline and the like. Two or more kinds of said organic solvent can be used together, and further a mixture of water and one or more of said organic solvents can be also used for the present invention.

In particular, oxygen containing solvents such as alcohol, ether and ketone, is a preferable since said metal compounds, especially said metal chlorides, have good solubility for said solvents.

To lower electric resistance of said thin film by forming low valence metal oxide or metal simple substance, fluoride (e.g. ammonium fluoride, hydrofluoric acid), hydroxy acid (e.g. malic acid, citric acid, tartaric acid) and the like may be added in said metal compound solution.

Further, water soluble resin (e.g. poly (acrylic acid), poly. (methacrylic acid), poly (sodium acrylate), poly (potassium acrylate), poly (ammonium acrylate), poly (sodium methacrylate), polyacrylamide, polyvinylalcohol), thermoplastic resin (e.g. poly (methyl methacrylate), polystyrene, poly (vinyl acetate)), synthetic rubber (e.g. acrylic rubber, isobutylene-isoprene rubber, polybutadiene rubber, polyisoprene rubber, chloroprene rubber, polyisobutylene rubber, polybutene rubber, isobutene-isoprene rubber, acrylate-butadiene rubber, styrene-butadiene rubber, acrylonitrilebutadiene rubber, pyridine-butadiene rubber, styrene-isoprene rubber, acrylonitrile-chloroprene rubber, styrene-chloroprene rubber) and the like may be added in said metal compound solution as a thickener. By adding said thickener, the amount of said metal compound solution coatings can be increased, adding to the thickness of said film.

To coat said metal compound solution on said base, a common coating method such as spray coating, roll coater coating, knife coater coating, curtain flow coating, dipping coating, screen printing, or the like can be applied. If desirable, the resulting film coating on said base can be dried at a room temperature, or by heating. After this, said film coated base is heated at commonly between 200° C. and 700° C., and ideally between 250° C. and 650° C.

In said heating process, metal compounds contained in said metal compound solution is oxidized to form said thin film containing zinc oxide and tin oxide. In said method wherein said metal compound solution is sprayed on said base set in the high temperature reaction chamber, the temperature in said reaction chamber is adjusted at commonly between 200° C. and 700° C., desirably between 250° C. and 650° C., ideally between 300° C. and 600° C. In this case, said metal compounds contained in said solution sprayed on said base produce metal oxide sediment to form said thin film of said metal oxides. Said thin film formed by said method gives a high heat conversion effectiveness.

Said thin film formed on said base as above-described may quickly generate heat by charging voltage in a wide range of between 3 volts and 380 volts with direct current or alternating current, and maximum temperature may reach about 900° C. The electric resistance of said thin film hardly changes by turning on electricity continuously or intermittently for long time so that said thin film has an excellent stability and a lower electricity consumption rate than that of the conventional panel-type heating element.

To adjust the electric resistance value of said thin film, other metal compounds, besides said zinc compound and said tin compound, such as an indium compound, an antimony compound and the like, and/or said fluoride, hydroxy carboxylic acid, and the like may be preferably added. In a case where said indium compound is added, heated with said tin compound, ITO is produced to obtain a thin film having a high electric resistance, and in a case where said antimony compound or especially said fluoride is added, the electric resistance of tin oxide descends to obtain a thin film having a low electric resistance.

EXAMPLE 1

Zinc chloride(10 g) and stannic chloride hydrate(15 g) were dissolved in refined ethanol(100 g). The resulting solution was sprayed on a SiC base(60 mm×130 mm) and then said SiC base on which a coating film of said solution was formed was heated at 420° C. for 30 minutes to form a thin film consisting of zinc oxide and tin oxide on said SiC base.

A silver powder paste was coated on the both sides of said thin film of the resulting panel-type heating element, and further copper foil was covered on the resulting coating film of said silver powder paste to form a pair of electrodes.

Under the conditions of a temperature of 27° C. and humidity of 50% RH, a direct electric current 13.5 volts 600 mA was sent to the both electrodes of said panel-type heating element to determine said thin film's resistance, which was found to be 22.5Ω. FIG. 1 details the results of further temperature ascending tests conducted under the same conditions.

Referring to FIG. 1, the surface temperature of said panel-type heating element reached 77° C. in about 10 minutes after the electric current was turned on, and after that, equilibrium state was maintained. The electric current was cut 15 minutes after it was turned on.

Said temperature ascending tests were repeated 100 times and it was confirmed that time-temperature curve in FIG. 1 hardly changes with each test and that said thin film's resistance(22.5Ω) did not ascend after 100 time repeated tests:

Sodium chloride aqueous solution(50 g/l) was sprayed on said panel-type heating element for 24 hours at 35° C. and then the electric resistance of said film was determined. As a result, no change of the electric resistance (22.5Ω) was determined. The heat conversion ratio of said panel-type heating element, at 93%, confirms a high effectiveness in saving electric power.

EXAMPLE 2

Zinc carbonate hydroxide(5 g), tin dihydroxide oxide(20 g), and indium trichloride(1g) were dissolved in aceton(100 g), and further an ethylacetate solution(10 g) in which 15% by weight of polymethykmethacrykate was dissolved as a thickener was added to the resulting solution.

Said solution prepared as above-described was coated on the surface of an epoxy resin panel(60 mm×90 mm) by silk screen printing and then said epoxy resin panel on whose surface said solution was coated was kept at a room temperature for one day to dry and then heated at 480° C. for 20 minutes to form a thin film consisting of zinc oxide, tin oxide, indium oxide, and a small amount of ITO on said epoxy resin panel.

A pair of electrodes were formed on the both sides of the resulting panel-type heating element by the same method as described in EXAMPLE 1.

Figure 2:
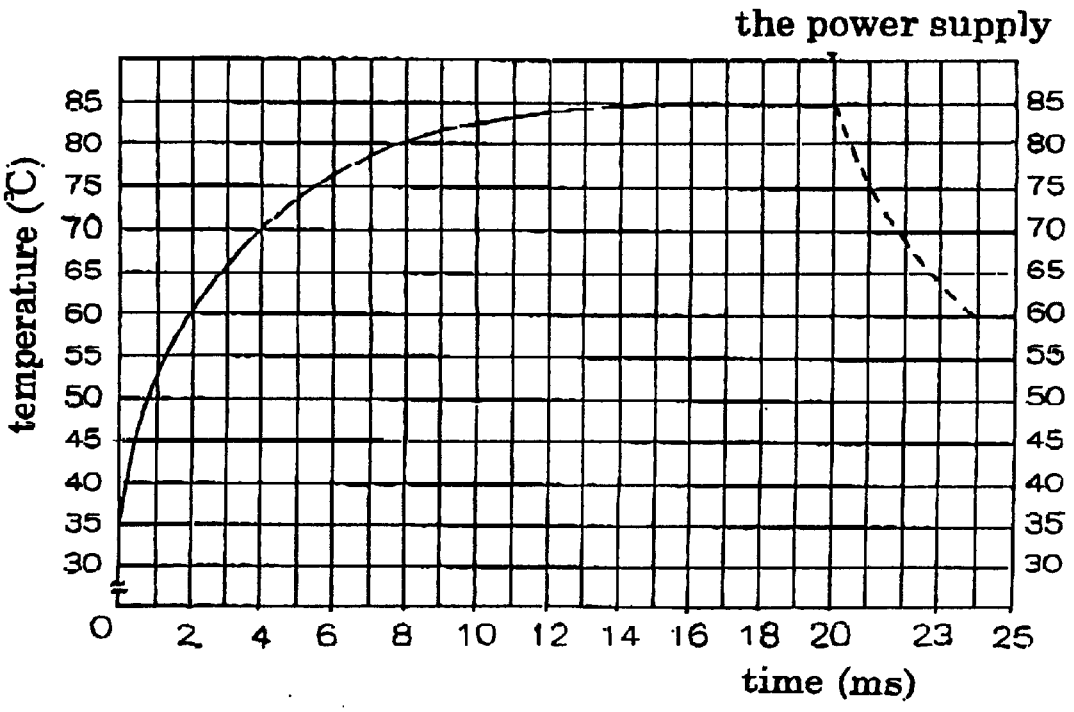
FIG. 2 is the ascending time-temperature test graph from EXAMPLE 2.

Under the conditions of a temperature of 29° C. and humidity of 90% RH, a direct electric current, 12 volts, 400 mA was sent to both electrodes of said panel-type heating element to determine said thin film's resistance, which was found to be 30Ω. FIG. 2 details the results of further temperature ascending tests conducted under the same conditions.

Referring to FIG. 2, the surface temperature of said panel-type heating element reached 85° C. in about 15 minutes after the electric current was turned on, and after that, equilibrium state was maintained. The electric current was cut 20 minutes after it was turned on.

Said temperature ascending tests were repeated 100 times, and it was confirmed that time-temperature curve in FIG. 2 hardly changes with each test and that said thin film's resistance(30Ω) did not ascend after 100 time repeated tests.

Sodium chloride aqueous solution spraying test the same as described in EXAMPLE 1 was carried out and, as a result, no change of the electric resistance(30Ω) was determined.

The heat conversion ratio of said panel-type heating element, at 91%, confirms a high effectiveness in saving electric power.

EXAMPLE 3

An ammonium fluoride aqueous solution (1 cc, 10% by weight) was combined and mixed well with the solution from EXAMPLE 1. A panel-type heating element was prepared using said solution by the same procedure as described in EXAMPLE 1.

Figure 3:
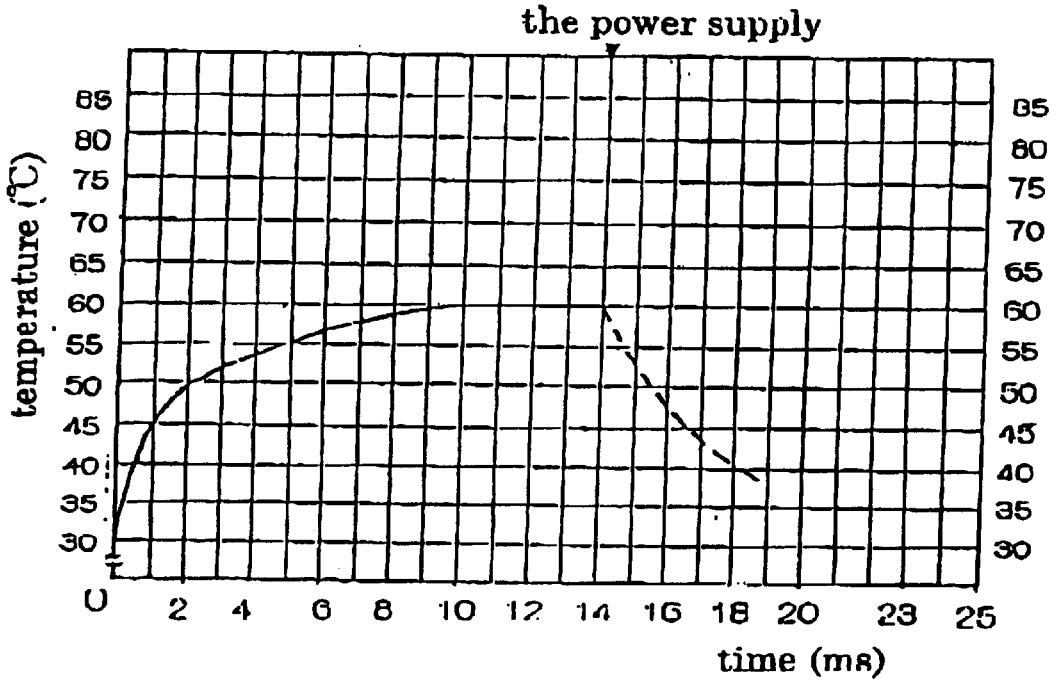
FIG. 3 is the ascending time-temperature test graph from EXAMPLE 3.

Under the conditions of a temperature 27° C. and humidity of 80% RH, a direct electric current of 13.5 volts, 600 mA was sent to the both electrodes of said panel-type heating element to determine said thin film's resistance, which was found to be 20.4Ω. FIG. 3 details the results of further temperature ascending tests conducted under the same conditions.

Referring to FIG. 3, the surface temperature of said panel-type heating element reached 60° C. in about ten minutes after the electric current was turned on, and after that, equilibrium state was maintained. The electric current was cut 14 minutes after it was turned on.

Said temperature ascending tests were repeated 100 times, and it was confirmed that time-temperature curve in FIG. 3 hardly changes with each test and that said thin film's resistance(20.4Ω) did not ascend after 100 time repeated tests.

The heat conversion ratio of said panel-type heating element, at 89%, confirms a high effectiveness in saving electric power.

EXAMPLE 4

A devitrified glass base(60 mm×130 mm) was set in a high temperature reaction chamber the inside of which was heated at 400° C. and the solution from EXAMPLE 1 was sprayed into said reaction chamber to form a thin film consisting of a sediment of zinc oxide and tin oxide on said devitrified glass base.

Figure 4:
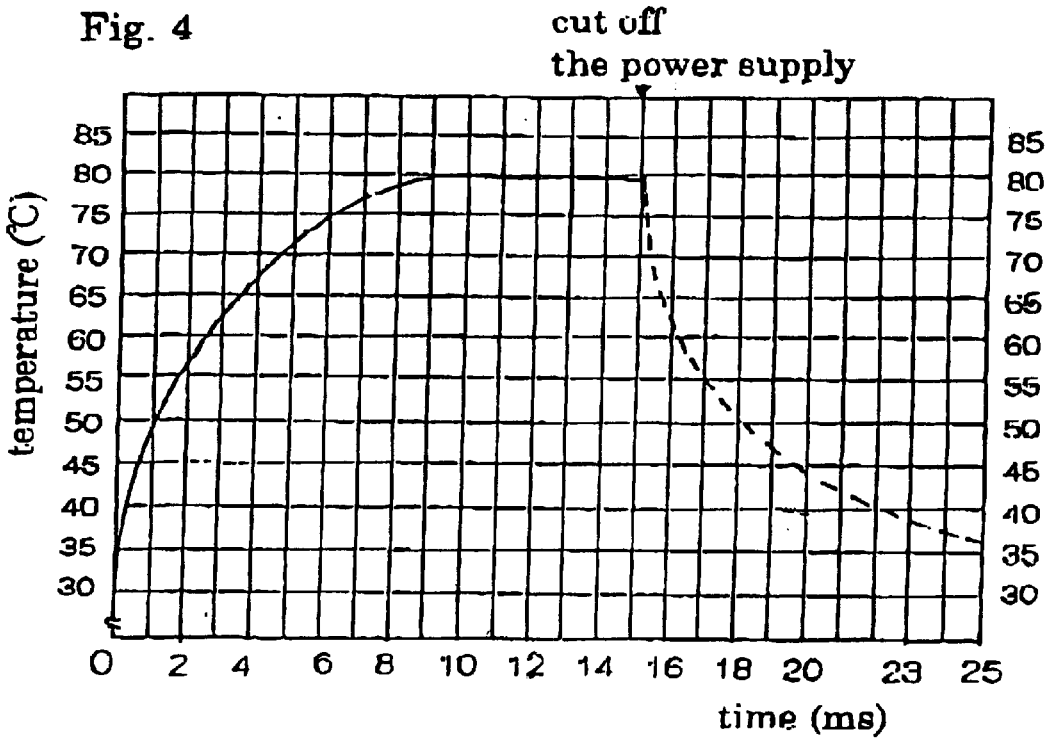
FIG. 4 is the ascending time-temperature test graph from EXAMPLE 4.

On the both sides of the resulting panel-type heating element the electrodes were formed by the same method as EXAMPLE 1. Under the conditions of a temperature of 27° C. and humidity of 80% RH, a direct electric current of 13.5 volts, 600 mA was sent to the both electrodes of said panel-type heating element to determine said thin film's resistance, which was found to be 23.4Ω. FIG. 4 details the results of further temperature ascending tests conducted under the same conditions.

Referring to FIG. 4, the surface temperature of said panel-type heating element reached nearly 80° C. in ten minutes, and after that, equilibrium state was maintained. The electric current was cut 15 minutes after it was turned on.

Said temperature ascending tests were repeated 100 times, and it was confirmed that time-temperature curve hardly changes with each test and that said thin film's resistance (23.4Ω) did not change after 100 time repeated tests.

The heat conversion ratio, at 94.7%, confirms a high effectiveness in saving electric power.

EFFECT OF THE INVENTION

Said panel-type heating element can be provided (manufactured and sold) at a low cost, heats faster and consumes 35% less electric power than a conventional sintered barium titanate thin film, has a stable resistance to electricity and the ability to maintain its stability for extended periods of time or sustained repeated periods of usage, in which the electric current is frequently connected/disconnected. Furthermore, its excellent chemical(water and acid) resistance gives said panel-type heating element great durability.

This panel-type heating element also has a wide range of potential applications for heating utensils such as in home-use water heaters, cooking utensils, in heat retaining utensils for tissue paper or food, and also for use in electric ovens and irons.

What is claimed is:

1. A method for the manufacture of a panel type heating element consisting of a base and a thin film containing zinc oxide and tin oxide formed on said base wherein said thin film is formed by spraying a solution containing a zinc compound and a tin compound which gives oxides respectively by heating in a high temperature reaction chamber.

2. A method for the manufacture of a panel-type heating element in accordance with claim 1, wherein said base consists of mica, ceramics, glass, porcelain or earthenware.

3. A method for the manufacture of a panel-type heating element in accordance with claim 2, comprising spraying a solution containing a zinc compound and a tin compound which gives oxides respectively by heating in a high temperature reaction chamber to form a thin film consisting of sediment containing zinc oxide and tin oxide on the surface of said base.

4. A method for the manufacture of a panel-type heating element in accordance with claim 1 wherein said base consists of plastics.

5. A method for the manufacture of a panel-type heating element in accordance with claim 4, comprising spraying a solution containing a zinc compound and a tin compound which gives oxide respectively by heating in a high temperature reaction chamber to form a thin film consisting of sediment containing zinc oxide and tin oxide on the surface of said base.

6. A method for the manufacture of a panel-type heating element in accordance with claim 1, comprising spraying a solution containing a zinc compound and a tin compound which gives oxides respectively by heating in a high temperature reaction chamber to form a thin film consisting of sediment containing zinc oxide and tin oxide on the surface of said base.

7. A method for the manufacture of panel-type heating element in accordance with claim 6, wherein the temperature of said reaction chamber us adjusted between 200° C. and 700° C.

* * * * *